US010822135B2

(12) United States Patent
Taruno et al.

(10) Patent No.: US 10,822,135 B2
(45) Date of Patent: Nov. 3, 2020

(54) DELAMINATABLE CONTAINER

(71) Applicant: KYORAKU CO., LTD., Kyoto (JP)

(72) Inventors: Shinsuke Taruno, Kanagawa (JP); Tetsuaki Eguchi, Kanagawa (JP); Tatsuro Aoki, Kanagawa (JP)

(73) Assignee: KYORAKU CO., LTD., Kyoto (JP)

( * ) Notice: Subject to any disclaimer, the term of this patent is extended or adjusted under 35 U.S.C. 154(b) by 162 days.

(21) Appl. No.: 15/780,855

(22) PCT Filed: Dec. 2, 2016

(86) PCT No.: PCT/JP2016/085883

§ 371 (c)(1),
(2) Date: Jun. 1, 2018

(87) PCT Pub. No.: WO2017/094880

PCT Pub. Date: Jun. 8, 2017

(65) Prior Publication Data

US 2018/0370673 A1 Dec. 27, 2018

(30) Foreign Application Priority Data

Dec. 3, 2015 (JP) ..... 2015-236867
Mar. 3, 2016 (JP) ..... 2016-041243
Mar. 16, 2016 (JP) ..... 2016-052673

(51) Int. Cl.
*B65D 23/02* (2006.01)
*B65D 47/36* (2006.01)
(Continued)

(52) U.S. Cl.
CPC ..... *B65D 1/0238* (2013.01); *B65D 1/023* (2013.01); *B65D 1/0246* (2013.01);
(Continued)

(58) Field of Classification Search
CPC .. B65D 1/0238; B65D 1/023; B65D 1/00246; B65D 41/185; B65D 51/22;
(Continued)

(56) References Cited

U.S. PATENT DOCUMENTS 5,332,121 A * 7/1994 Schmidt ..... B29C 45/1646 222/105
6,266,943 B1 7/2001 Nomoto et al.
(Continued)

FOREIGN PATENT DOCUMENTS

CN 201217541 Y 4/2009
JP S62-191667 U 12/1987
(Continued)

OTHER PUBLICATIONS

Partial European Search Report dated Nov. 6, 2018 in corresponding European Patent Application No. 16870815.4; 10 pgs.
(Continued)

*Primary Examiner* — J. Gregory Pickett
*Assistant Examiner* — Niki M Eloshway
(74) *Attorney, Agent, or Firm* — Maier & Maier, PLLC

(57) ABSTRACT

A delaminatable container, including: a container body; and a press-fit cap mounted to the container body. The container body is configured to include a storage portion to store contents and a mouth having an opening to discharge the contents from the storage portion, the storage portion and the mouth having an outer layer and an inner layer, and having an inner bag composed of the inner layer to be shrunk with a decrease in the contents, the mouth includes a mouth-side engagement section provided along an outer circumferential surface of the mouth, the cap includes a cap-side engagement section provided along an inner circumferential surface of the cap, the mouth-side engagement section and the
(Continued)

SEVENTH EMBODIMENT cap-side engagement section are configured to be engageable with each other while the cap is mounted to the mouth.

8 Claims, 16 Drawing Sheets

(51) Int. Cl.

| | |
|---|---|
| ***B65D 1/02*** | (2006.01) |
| ***B65D 83/00*** | (2006.01) |
| ***B65D 41/18*** | (2006.01) |
| ***B65D 51/22*** | (2006.01) |
| ***B65D 77/06*** | (2006.01) |
| ***B65D 77/22*** | (2006.01) |

(52) U.S. Cl.
CPC ..... *B65D 41/185* (2013.01); *B65D 51/22* (2013.01); *B65D 51/222* (2013.01); *B65D 77/06* (2013.01); *B65D 77/225* (2013.01); *B65D 83/0055* (2013.01); *B65D 1/0215* (2013.01); *B65D 2251/0025* (2013.01); *B65D 2251/0093* (2013.01)

(58) Field of Classification Search
CPC .... B65D 51/222; B65D 77/06; B65D 77/225; B65D 83/0055
USPC ..... 215/48, 12.1, 235
See application file for complete search history.

(56) References Cited

U.S. PATENT DOCUMENTS

| | | | | |
|---|---|---|---|---|
| 2001/0027154 | A1 | 10/2001 | Nomoto et al. | |
| 2004/0112921 | A1 | 6/2004 | Nomoto et al. | |
| 2008/0302757 | A1* | 12/2008 | Furusawa | B29B 11/14 215/373 |
| 2010/0059473 | A1* | 3/2010 | Kitamura | B31D 1/0018 215/233 |
| 2014/0110282 | A1* | 4/2014 | Lee | B65D 51/222 206/219 |
| 2014/0190992 | A1 | 7/2014 | Kuwagaki et al. | |
| 2015/0353245 | A1* | 12/2015 | Sakimura | B65D 47/20 222/545 |
| 2016/0200491 | A1* | 7/2016 | Dubach | B65D 51/222 222/83 |
| 2017/0029156 | A1* | 2/2017 | Eguchi | B65D 23/02 |
| 2017/0029157 | A1 | 2/2017 | Taruno et al. | |
| 2017/0036802 | A1 | 2/2017 | Taruno | |
| 2017/0197749 | A1* | 7/2017 | Eguchi | B65D 1/32 |
| 2017/0313462 | A1* | 11/2017 | Taruno | B65D 83/0055 |
| 2018/0003093 | A1* | 1/2018 | Oso | F02F 7/0073 |
| 2018/0016050 | A1* | 1/2018 | Eguchi | B65D 1/02 |
| 2018/0111724 | A1* | 4/2018 | Sakimura | B65D 47/08 |
| 2018/0327130 | A1* | 11/2018 | Taruno | B65D 23/02 |
| 2018/0370673 | A1* | 12/2018 | Taruno | B65D 1/023 |
| 2019/0100344 | A1* | 4/2019 | Taruno | B65D 1/02 |
| 2019/0256239 | A1 | 8/2019 | Taruno | |
| 2019/0344948 | A1* | 11/2019 | Kutsuzawa | B65D 79/005 |
| 2019/0375561 | A1* | 12/2019 | Taruno | B65D 41/02 |

FOREIGN PATENT DOCUMENTS

| | | | |
|---|---|---|---|
| JP | H02-45967 | U | 3/1990 |
| JP | H04-267727 | A | 9/1992 |
| JP | H04-115114 | U | 10/1992 |
| JP | H07-112749 | A | 5/1995 |
| JP | 3650175 | B2 | 5/2005 |
| JP | 2007-320645 | A | 12/2007 |
| JP | 2010-126207 | A | 6/2010 |
| JP | 2012-076758 | A | 4/2012 |
| JP | 2013-035557 | A | 2/2013 |
| JP | 2013-071776 | A | 4/2013 |
| JP | 2013-071782 | A | 4/2013 |
| JP | 2015-101396 | A | 6/2015 |
| JP | 2015-131676 | A | 7/2015 |
| WO | 2015/080015 | A1 | 6/2015 |

OTHER PUBLICATIONS

Office Action dated Sep. 10, 2019, in corresponding Japanese Application No. 2015-236867; 12 pages.
Office Action dated Sep. 24, 2019, in corresponding Chinese Application No. 201680069966.8; 11 pages.
International Search Report dated Feb. 7, 2017 of corresponding International Application No. PCT/JP2016/085883; 5 pgs.

* cited by examiner

Fig. 6 COMPARATIVE EXAMPLE
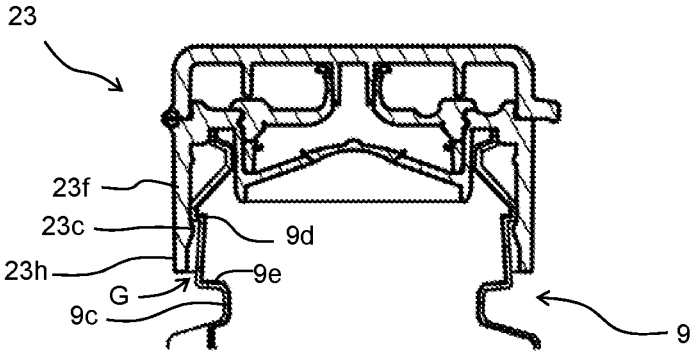

SECOND EMBODIMENT

THIRD EMBODIMENT

FOURTH EMBODIMENT

FIFTH EMBODIMENT

SIXTH EMBODIMENT

Fig. 14 SEVENTH EMBODIMENT
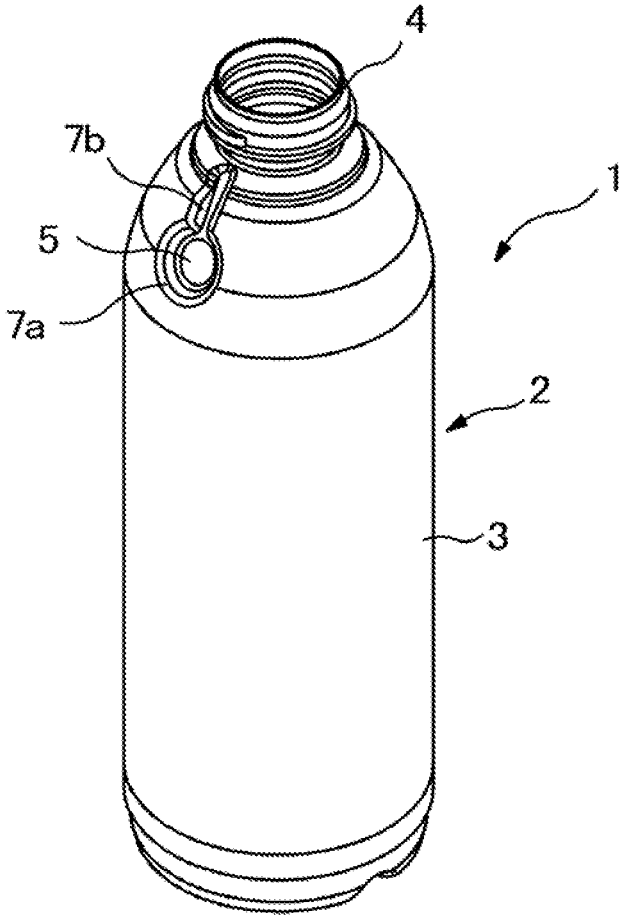

Fig. 15 SEVENTH EMBODIMENT
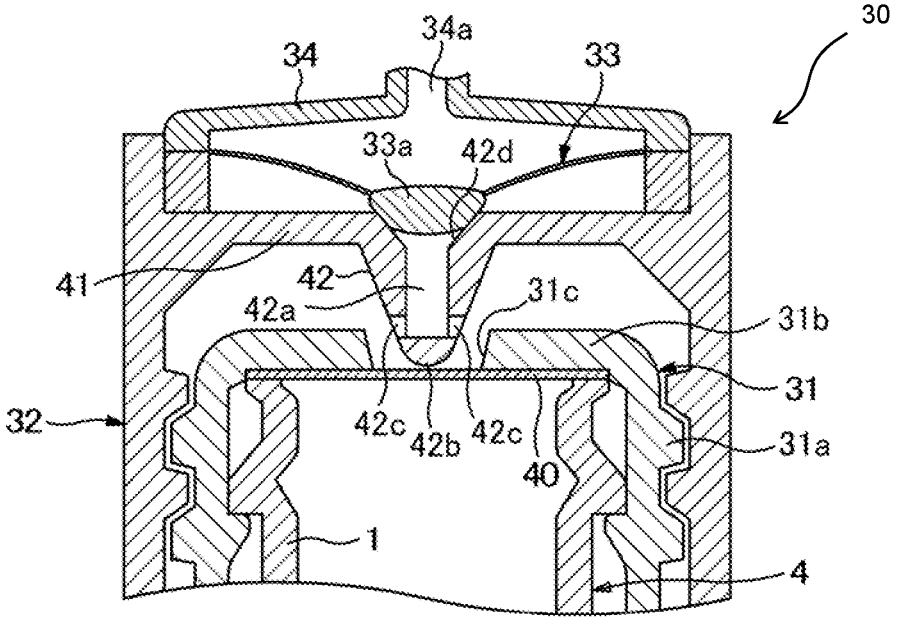
Fig. 16 SEVENTH EMBODIMENT
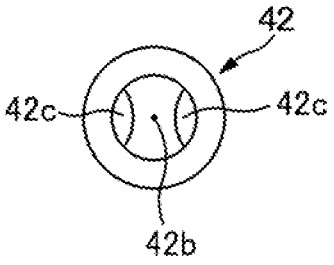

Fig. 17 SEVENTH EMBODIMENT
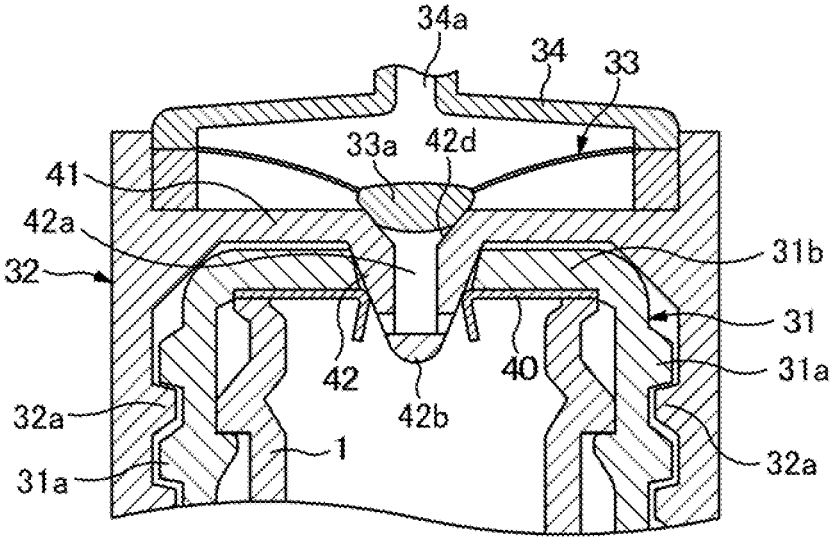

DELAMINATABLE CONTAINER

TECHNICAL FIELD

The present invention relates to a delaminatable container having an inner bag composed of an inner layer to be shrunk with a decrease in contents.

BACKGROUND ART

First Aspect

There are known delaminatable containers that inhibit entrance of air into the container using an inner bag composed of an inner layer to be shrunk with a decrease in contents (e.g., PTSs 1 to 5). Such a delaminatable container is generally used by mounting a cap having a check valve to a mouth of a container body.

Second Aspect

The delaminatable container in PTL 2 is configured to open and close a fresh air inlet by mounting a valve member to a fresh air inlet formed in an outer shell of a container body and moving the valve member relatively to the container body.

Third Aspect

The delaminatable container disclosed in PTL 3 has a cap mounted to a mouth of a container body having a built-in valve. The delaminatable container disclosed in PTL 4 has a valve provided inside a body of an outer shell.

Such a delaminatable container has an advantage that the contents in the inner bag are not in contact with air. The container is also provided with a check valve in the cap not to flow the air back into the inner bag after pouring the contents. The container is further proposed to seal the mouth by an aluminum seal to secure tight closure during storage (e.g., refer to PTL 5).

PTL 5 discloses a tube container in which a mouth of a tube body having non-transmittance of oxygen and an elastic restoring force is closed by a sealing material having non-transmittance of oxygen, a plug tube having a pouring hole is removably mounted to the mouth, the pouring hole in the plug tube is opened and closed by a valve that is closed by a negative pressure in the tube body, and the cap is fit to the plug tube to remove the sealing material and unseal the mouth.

CITATION LIST

Patent Literature

PTL 1: Japanese Patent No. 3650175
PTL 2: WO/2015/080015
PTL 3: JP 2013-35557A
PTL 4: JP 4-267727A
PTL 5: JP 7-112749A

SUMMARY OF INVENTION

Technical Problem

First Aspect

The present inventors tested container bodies of a delaminatable container with a press-fit cap mounted to the body and found that fresh air sometimes entered into the container body through a gap between the container body and the cap. Since entrance of fresh air into the container body promotes content degradation, it is desired to inhibit entrance of fresh air into the container body.

The first aspect of the present invention has been made in view of such circumstances and is to provide a delaminatable container capable of inhibiting entrance of fresh air into the container body.

Second Aspect

In the configuration in PTL 2, the valve member is pressed against the outer shell by the inner bag, sometimes causing interference with movement of the valve member. In the case of such interference with movement of the valve member, fresh air is not appropriately introduced at a timing to introduce fresh air into a space between the outer shell and the inner bag through the fresh air inlet after discharge of the contents, and as a result, restorability of the outer shell sometimes becomes worse.

The second aspect of the present invention has been made in view of such circumstances and is to provide a delaminatable container capable of immediate introduction of fresh air into the space between the outer shell and the inner bag after discharge of the contents.

Third Aspect

Although closure by a sealing material as described in PTL 5 is effective for security of storage life, unsealing by a cutting blade in a tubular shape as described in PTL 5 may cause a risk of various troubles. For example, fragments of the sealing material may remain attached to the cutting blade after cutting to close the flow passage. As another example, when the sealing material is unsealed by a cutting blade in a tubular shape, it is difficult to maintain tight closure. To maintain tight closure after unsealing, an outer circumferential surface of the cutting blade has to closely contact with an inner circumferential surface of the mouth, requiring high molding precision of the cutting blade and leading to an increase in costs.

The third aspect of the present invention has been made in view of such circumstances and is to provide a delaminatable container capable of maintaining airtightness during storage, resolving troubles for unsealing, and maintaining tight closure even after unsealing.

Solution to Problem

A description is given below to solutions to the problems in the first to third aspects. The solutions in the first to third aspects below may be combined with each other.

First Aspect

The first aspect of the present invention provides a delaminatable container, including: a container body; and a press-fit cap mounted to the container body, wherein the container body is configured to include a storage portion to store contents and a mouth having an opening to discharge the contents from the storage portion, the storage portion and the mouth having an outer layer and an inner layer, and having an inner bag composed of the inner layer to be shrunk with a decrease in the contents, the mouth includes a mouth-side engagement section provided along an outer circumferential surface of the mouth, the cap includes a cap-side engagement section provided along an inner circumferential surface of the cap, the mouth-side engagement section and the cap-side engagement section are configured to be engageable with each other while the cap is mounted to the mouth, and at least one of the cap and the mouth includes a tilt suppressor to suppress a tilt of the cap relative to the mouth by narrowing a gap between the mouth and the cap in a position more distant from the opening than the cap-side engagement section while the cap is mounted to the mouth.

The present inventors conducted a research on the cause of entrance of fresh air and found the cause that, depending on the shape of a mouth of a container body and the shape of a press-fit cap, the cap is sometimes prone to tilt relative to the mouth and a tilt of the cap causes a gap between the cap and the mouth. Based on the findings, a tilt suppressor to suppress a tilt of the cap relative to the mouth is provided to allow inhibition of entrance of fresh air into the container body, and thus have come to complete the present invention.

Various embodiments in the first aspect of the present invention are described below as examples. The embodiments below may be combined with each other.

Preferably, the tilt suppressor is a mouth-side protrusion provided on the outer circumference of the mouth.

Preferably, the container further includes a constriction section constricting inside the mouth provided on a storage portion side from the mouth-side engagement section, wherein the mouth-side protrusion is provided between an upper wall of the constriction section and the mouth-side engagement section.

Preferably, the tilt suppressor is a cap-side protrusion provided on the inner circumferential surface of the cap.

Preferably, the storage portion includes a fresh air inlet communicating an external space with an intermediate space between the outer layer and the inner layer.

Second Aspect

The second aspect of the present invention provides a delaminatable container including a container body having an outer shell and an inner bag, the inner bag to be shrunk with a decrease in contents, wherein the outer shell includes a fresh air inlet communicating with an external space of the of the container body, and the inner bag has a surface area in an area facing the fresh air inlet greater than an open area of the fresh air inlet.

The inner bag of the delaminatable container of the present invention has a surface area in an area facing the fresh air inlet greater than an open area of the fresh air inlet formed in the outer shell. The tension developed in the inner bag when the inner bag is pressed by the valve member mounted to the fresh air inlet is thus reduced, and as a result, the force to press the valve member against the outer shell by the inner bag becomes weaker. Accordingly, without interference with movement of the valve member, fresh air is immediately introduced into the space between the outer shell and the inner bag through the fresh air inlet after discharge of the contents.

Various embodiments in the second aspect of the present invention are described below as examples. The embodiments below may be combined with each other.

Preferably, the inner bag includes a recess recessed towards inside the container body in an area facing the fresh air inlet.

Preferably, the recess includes a tube section having an approximately constant cross-sectional area towards inside the container body.

Preferably, the recess includes a curved surface recessed towards inside the container body.

Preferably, the container body includes a storage portion to store the contents and a mouth to discharge the contents from the storage portion, and the fresh air inlet is provided in the storage portion.

Preferably, a valve member is mounted to the fresh air inlet, and the valve member is configured to open and close the fresh air inlet by opening and closing a gap between an edge of the fresh air inlet and the valve member by movement of the valve member.

Preferably, the valve member includes a stem inserted into the fresh air inlet, a lid provided on an intermediate space side in the stem and having a cross-sectional area greater than that of the stem, and a locking portion provided on a side of the external space in the stem and preventing entrance of the valve member to the intermediate space.

Another aspect of the present invention provides a method of producing a delaminatable container, including: producing a container body having an outer shell and an inner bag delaminatable from each other by blow molding a laminated parison in a molten state, the outer shell and the inner bag having a recess or a convexity; and forming a fresh air inlet in the outer shell in a region containing the recess or the convexity.

Third Aspect

To achieve the above objects, a delaminatable container in the third aspect of the present invention includes an outer shell and an inner bag, the inner bag to delaminate from the outer shell and be shrunk with a decrease in contents, wherein a mouth is sealed by a sealing member and a cap having a check valve is mounted to the mouth, the cap has an inner plug with a protrusion formed protruding towards the sealing member, the protrusion has an end in a peak shape and is formed with a content flow passage from a midway position thereof penetrating to an outflow side of the inner plug, and, by screwing the cap in, the protrusion of the inner plug breaks through the sealing member for unsealing.

The mouth is sealed by the sealing member to certainly secure tight closure during storage. In addition, the sealing member is unsealed by the protrusion having an end in a peak shape and formed with a content flow passage from a midway position thereof penetrating to an outflow side of the inner plug, thereby suppressing failures such as flow passage closure due to attachment of fragments. The present invention provides a delaminatable container capable of maintaining airtightness during storage, resolving troubles for unsealing, and maintaining tight closure even after unsealing.

Various embodiments in the third aspect of the present invention are described below as examples. The embodiments below may be combined with each other.

Preferably, the sealing member is fixed with its surroundings put between the mouth and an inner cap, the inner cap having a hole formed in a position facing the protrusion, and when the cap is screwed in, a circumferential surface of the protrusion in the peak shape abuts on a periphery of the hole of the inner cap.

Preferably, the check valve opens and closes an opening on the outflow side of the content flow passage formed in the protrusion.

Preferably, the sealing member is a multilayered film having a polypropylene layer, an aluminum layer, and a polypropylene layer laminated in this order.

BRIEF DESCRIPTION OF DRAWINGS

Drawings of Embodiments in the First Aspect of the Invention

FIG. 1A is a front view of a state of mounting a cap 23 and a valve member 5 to a container body 2 and FIG. 1B is a front view only illustrating the container body 2.

FIG. 6 is a cross-sectional view illustrating a mouth 9 and a cap 23 in Comparative Example of the present invention corresponding to FIG. 2A.

Drawings of Embodiments in the Second Aspect of the Present Invention

Figure 8A:
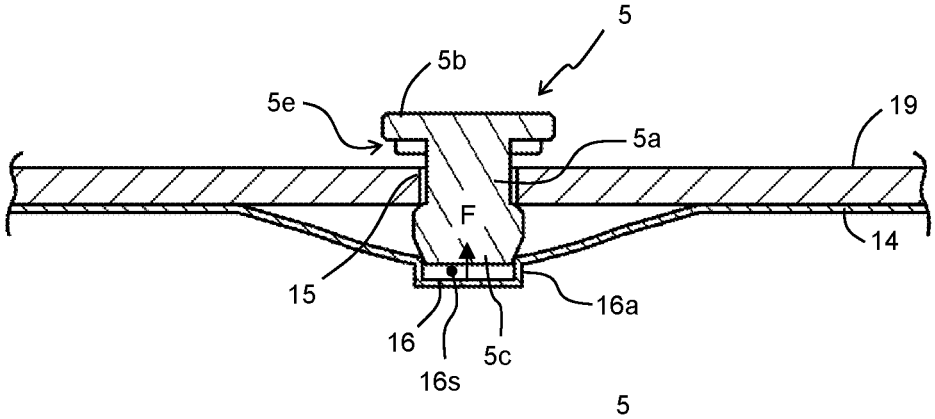
Figure 8B:
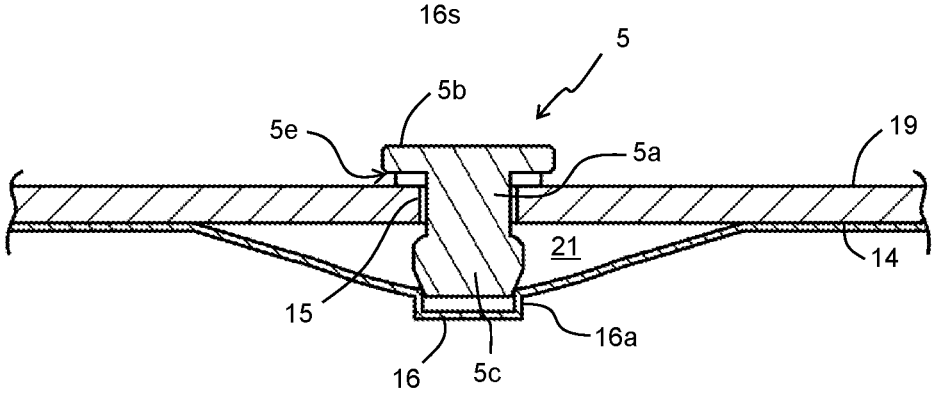

FIGS. 8A and 8B are schematic cross-sectional views to illustrate that, in a delaminatable container 1 in the third embodiment of the present invention, an inner bag 14 is provided with a recess 16 to reduce the force to press a valve member 5 against an outer shell 19 by the inner bag 14.

Figure 9A:
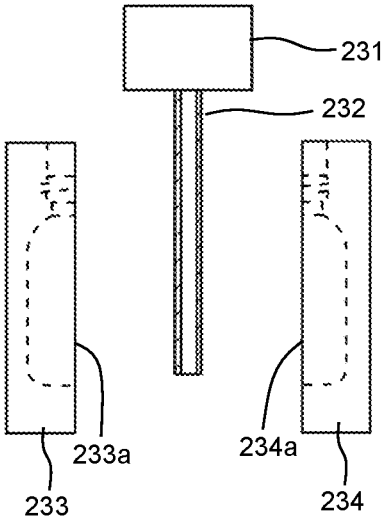
Figure 9B:
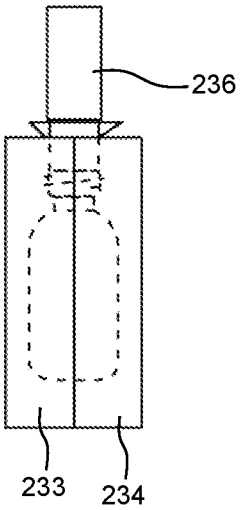
Figure 9C:
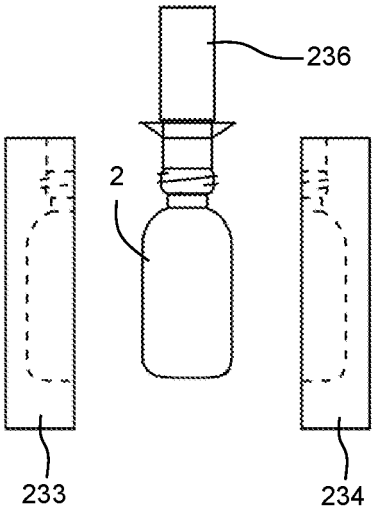

FIGS. 9A to 9C are schematic diagrams illustrating a production procedure of the delaminatable container 1 in the third embodiment of the present invention.

FIGS. 10A to 10E are cross-sectional views illustrating a production procedure of the delaminatable container 1 in the third embodiment of the present invention by enlarging a region to form a fresh air inlet 15 with the surrounding area.

FIGS. 11A to 11E are cross-sectional views illustrating a production procedure of a delaminatable container 1 in the fourth embodiment of the present invention corresponding to FIGS. 10A to 10E.

FIGS. 12A to 12E are cross-sectional views illustrating a production procedure of a delaminatable container 1 in the fifth embodiment of the present invention corresponding to FIGS. 11A to 11E.

FIGS. 13A to 13E are cross-sectional views illustrating a production procedure of a delaminatable container 1 in the sixth embodiment of the present invention corresponding to FIGS. 11A to 11E.

Drawings of Embodiments in the Third Aspect of the Present Invention

FIG. 14 is a perspective view illustrating a structure of a delaminatable container 1 in the seventh embodiment of the present invention.

FIG. 15 is a schematic cross-sectional view of a cap mounting portion with a sealing member not unsealed.

FIG. 16 is a schematic bottom view of a protrusion provided in an inner plug.

FIG. 17 is a schematic cross-sectional view of the cap mounting portion with the sealing member unsealed.

DESCRIPTION OF EMBODIMENTS

Embodiments of the present invention are described below. Various characteristics in the embodiments described below may be combined with each other. Each characteristic is independently inventive. The first and second embodiments mainly relate to the first aspect of the present invention. The third to sixth embodiments mainly relate to the second aspect of the present invention. The seventh embodiment mainly relates to the third aspect of the present invention.

1. First Embodiment

As illustrated in FIGS. 1A to 2C, a delaminatable container 1 in the first embodiment of the present invention includes a container body 2, a valve member 5, and a press-fit cap 23 mounted to the container body 2. The container body 2 is provided with a storage portion 7 to store the contents and a mouth 9 having an opening 9*g* to discharge the contents from the storage portion 7.

Figure 1A:
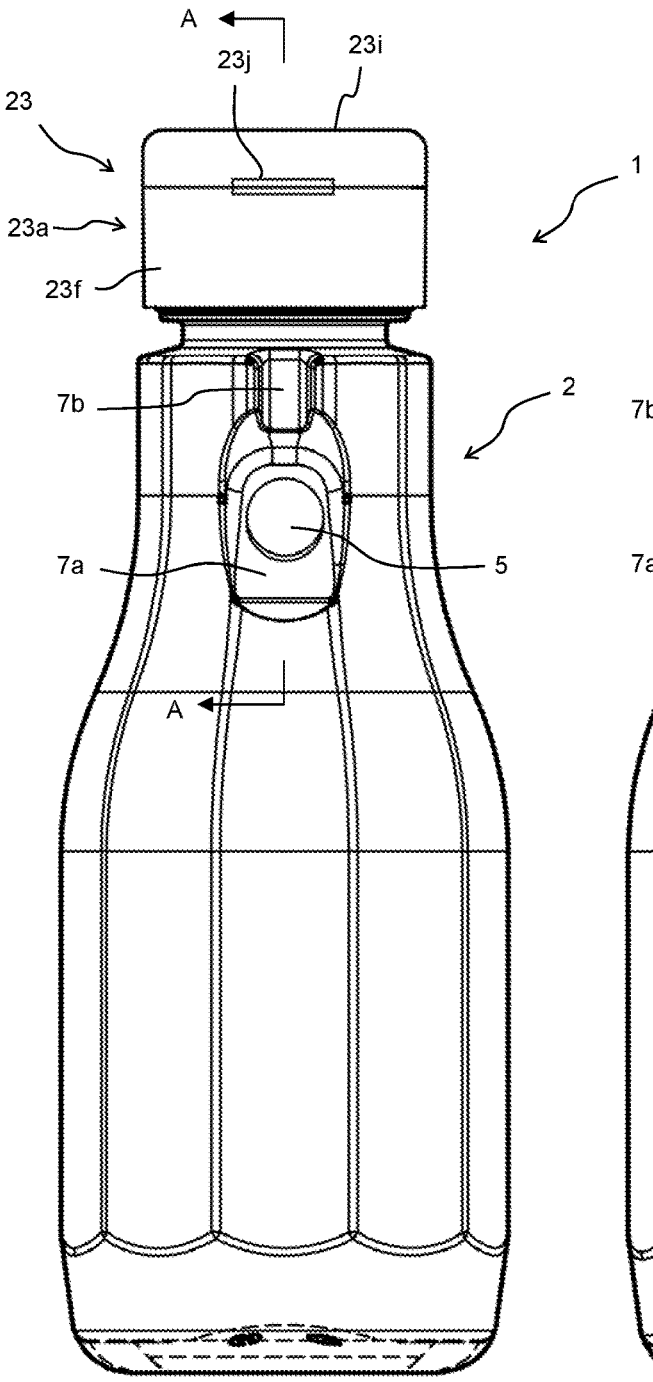
FIGS. 1A and 1B illustrate a delaminatable container 1 in the first embodiment of the present invention, where
Figure 1B:
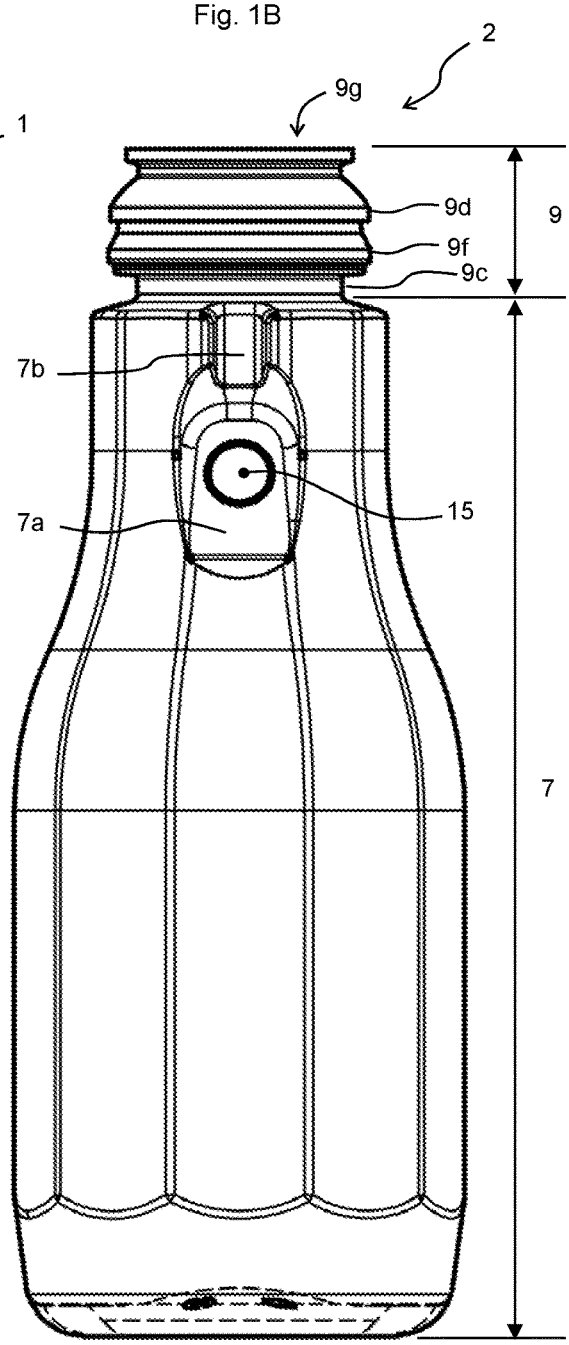
Figure 2A:
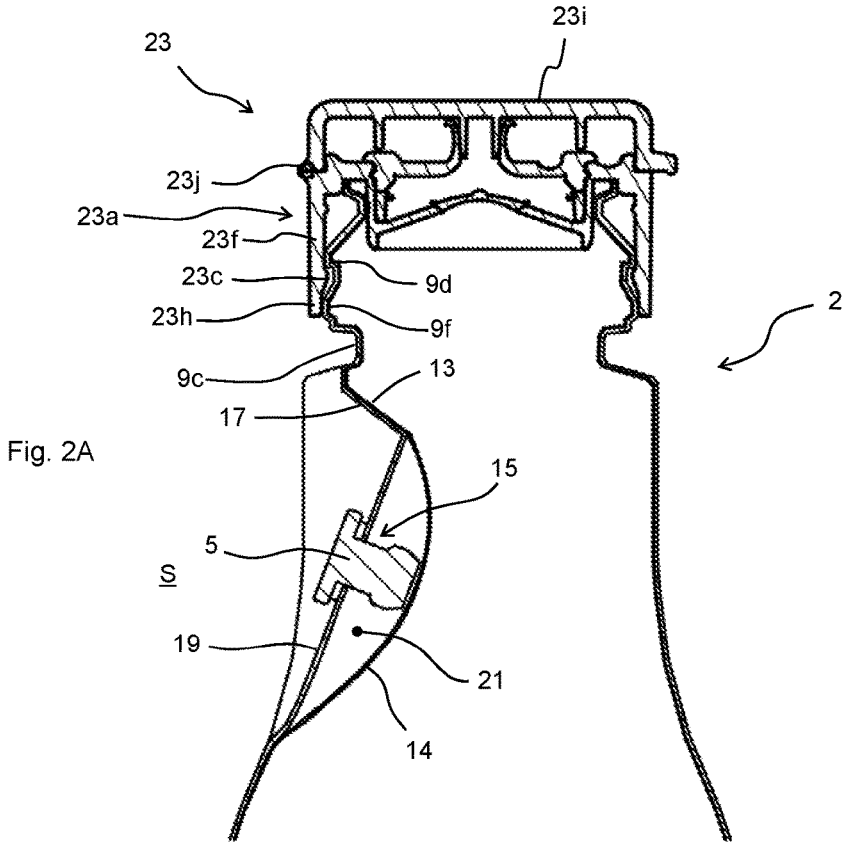
FIG. 2A is an A-A cross-sectional view in FIG. 1A.
Figure 2B:
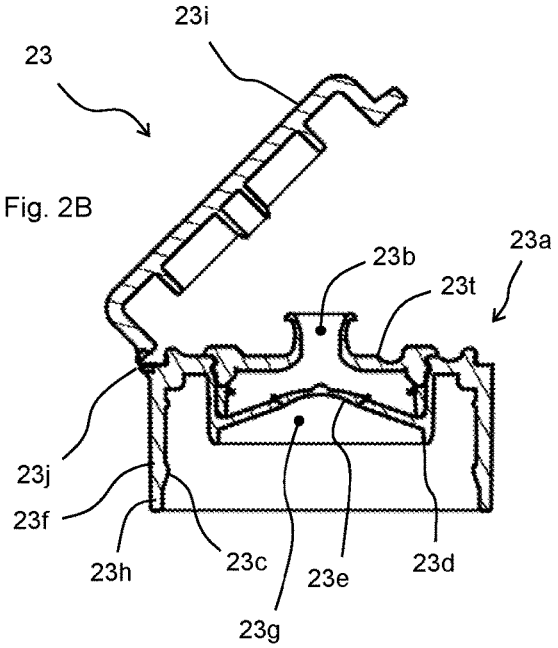
FIG. 2B is a cross-sectional view in a state of opening a cap cover 23*i* of the cap 23 in FIG. 2A.
Figure 2C:
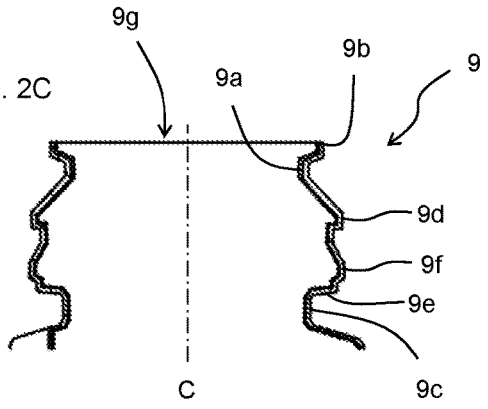
FIG. 2C is a cross-sectional view of a mouth 9 extracted from FIG. 2A.

As illustrated in FIGS. 2A to 2C, the container body 2 includes an outer layer 17 and an inner layer 13 in the storage portion 7 and the mouth 9, where the outer layer 17 constitutes an outer shell 19 and the inner layer 13 constitutes an inner bag 14. Due to separation of the inner layer 13 from the outer layer 17 with a decrease in the contents, the inner bag 14 separates from the outer shell 19 to be shrunk. Preliminary delamination is sometimes performed to delaminate the inner layer 13 from the outer layer 17 before storage of the contents in the storage portion 7. In this case, the inner layer 13 is contacted with the outer layer 17 by blowing air or storing the contents in the storage portion 7 after preliminary delamination. The inner layer 13 then separates from the outer layer 17 with a decrease in the contents. Meanwhile, when preliminary delamination is not performed, the inner layer 13 is delaminated from the outer layer 17 in discharge of the contents to separate from the outer layer 17.

The mouth 9 is provided with an engagement section 9*d* along an outer circumferential surface of the mouth 9. In the present embodiment, the mouth 9 is assumed to have a press-fit cap 23 mounted thereto, and the engagement section 9*d* is an annular projection engageable with an engagement section 23*c* of the cap 23.

The mouth 9 also includes a constriction section 9*c* constricting inside the mouth 9 on the storage portion 7 side from the engagement section 9*d*. The constriction section 9*c* has an upper wall 9*e* extending approximately vertically to a central axis C of the mouth 9.

Next, with reference to FIGS. 2A to 3B, a method of mounting the cap 23 to the mouth 9 is described. As illustrated in FIG. 2B, the cap 23 to be mounted includes a cap body 23*a* and a cap cover 23*i*. The cap body 23*a* and the cap cover 23*i* are coupled in a coupling portion 23*j* to allow opening and closing of the cap cover 23*i*. The cap body 23*a* includes an upper portion 23*t*, an outlet 23*b* provided in the upper portion 23*t*, a tube section 23*f* cylindrically extending from the upper portion 23*t*, the engagement section 23*c* provided along an inner circumferential surface of the tube section 23*f*, an inner ring 23*d* cylindrically extending from the upper portion 23*t* inside the tube section 23*f*, a flow passage 23*g* provided inside the inner ring 23*d* and communicating with the outlet 23*b*, and a check valve 23*e* provided in the flow passage 23*g*. The engagement section 23*c* is an annular projection engageable with the engagement section 9*d* of the mouth 9. While the cap 23 is mounted to the mouth 9, the contents in the storage portion 7 are discharged from the outlet 23*b* through the flow passage 23*g*. Meanwhile, the check valve 23*e* blocks an incoming flow of fresh air from the outlet 23*b*, and fresh air does not enter inside the inner bag 14 of the container body 2 to inhibit content degradation. The structure of the cap 23 described here is merely an example, and for example, a cap 23 having a check valve of another configuration may be employed.

Figure 3A:
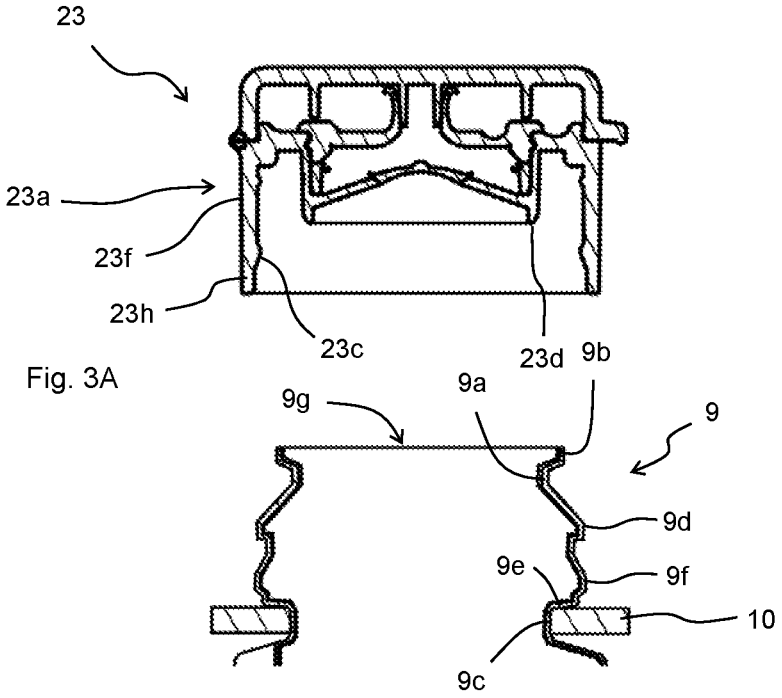
FIGS. 3A and 3B are cross-sectional views corresponding to FIG. 2A to illustrate the procedure of mounting the cap 23 to the mouth 9.
Figure 3B:
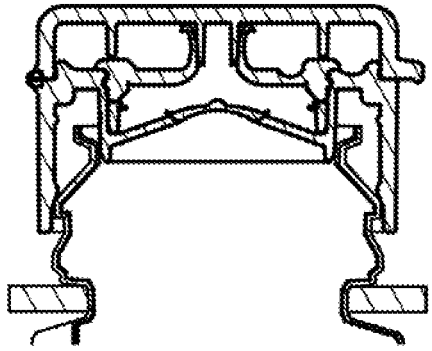

For mounting of the cap 23, first, to suppress deformation of the storage portion 7 due to the impact of mounting the cap 23, as illustrated in FIG. 3A, a support 10 is brought to abut on a lower surface of the upper wall 9*e* of the constriction section 9*c*. In that state, as illustrated in FIG. 3B, the engagement section 23*c* of the cap 23 is brought to abut on the engagement section 9*d* of the mouth 9. From this state, the cap 23 is further pressed, and as illustrated in FIG. 2A, the engagement section 23*c* passes over the engagement section 9*d* and thus the engagement section 23*c* is engaged with the engagement section 9*d*. When the engagement section 23*c* passes over the engagement section 9*d* from the state in FIG. 3B, the tube section 23*f* of the cap 23 transforms to enlarge the diameter and the mouth 9 transforms to reduce the diameter, and thus it is easier to mount the cap 23 when the mouth 9 readily transforms. The mouth 9 in the present embodiment is not provided with a support ring as disclosed in JP 11-292112A and the mouth 9 is supported by having the support 10 abutting on the lower surface of the upper wall 9*e* of the constriction section 9*c*. The mouth 9 thus readily transforms, and mounting of the cap 23 is facilitated. In addition, since the mouth 9 readily transform, the inner bag 14 readily transform in the area near a container opening and it helps to use the contents up.

The mouth 9 also includes an abutment section 9*a* on which an outer surface of the inner ring 23*d* abuts. Leakage of the contents and introduction of fresh air into the container body 2 are prevented by the outer surface of the inner ring 23*d* abutting on the abutment section 9*a* of the mouth 9. In the present embodiment, the mouth 9 is equipped with an enlarged diameter portion 9*b* at the end. The enlarged diameter portion 9*b* has an inner diameter greater than the inner diameter in an abutment section 9*a*, and thus the outer surface of the inner ring 23*d* is not in contact with the enlarged diameter portion 9*b*. When the mouth 9 does not have the enlarged diameter portion 9*b*, a defect sometimes occurs in which the inner ring 23*d* enters between the outer layer 17 and the inner layer 13 in the case where the mouth 9 has an even slightly smaller inner diameter due to variations in manufacturing. In contrast, when the mouth 9 has the enlarged diameter portion 9*b*, such defect does not occur even in the case where the mouth 9 has a slightly varied inner diameter.

Even when the mouth 9 includes the enlarged diameter portion 9*b*, there is a risk of delamination of the inner layer 13 from the outer layer 17 due to the friction between the inner ring 23*d* and the abutment section 9*a*. In the present embodiment, however, the constriction section 9*c* is provided in a position closer to the storage portion 7 than the abutment section 9*a* to inhibit slipping off of the inner layer 13 by the constriction section 9*c*. Dropping of the inner bag 14 into the outer shell 19 is thus inhibited. The constriction section 9*c* thus has a function of inhibiting slipping off of the inner layer 13 and also has a function as a support area for the mouth 9 by the support 10 when the cap 23 is mounted.

In the present embodiment as illustrated in FIG. 2C, a protrusion 9*f* is provided in a position more distant from the opening 9*g* (position closer to the storage portion 7) than the engagement section 9*d*. The protrusion 9*f* is provided between the engagement section 9*d* and the upper wall 9*e* of the constriction section 9*c*. In other words, while the cap 23 is mounted to the mouth 9 as illustrated in FIG. 2A, the protrusion 9*f* is provided in a position more distant from the opening 9*g* than the engagement section 23*c* of the cap 23. The protrusion 9*f* is formed by enlarging the diameter in the area between the engagement section 9*d* and the upper wall 9*e* of the constriction section 9*c*.

As illustrated in Comparative Example in FIG. 6, if there is no protrusion 9*f* between the engagement section 9*d* and the upper wall 9*e* of the constriction section 9*c*, a large gap G is formed between an end 23*h* of the tube section 23*f* and the mouth 9. The presence of the gap G tends to cause a tilt of the cap 23, and the tilt may cause separation of the inner ring 23*d* from the abutment section 9*a* and entrance of fresh air inside the container body 2. In contrast, in the present embodiment, the protrusion 9*f* is provided between the engagement section 9*d* and the upper wall 9*e* of the constriction section 9*c*. There is thus only a small or no gap between the end 23*h* of the tube section 23*f* and the mouth 9 to suppress the tilt of the cap 23 relative to the mouth 9 and inhibit the entrance of fresh air inside the container body 2. In the present embodiment, the protrusion 9*f* functions as "the tilt suppressor" in the appended claims. The protrusion 9*f* may be, or does not have to be, in contact with the end 23*h*. The protrusion 9*f* and the end 23*h* in contact have an advantage of more effective suppression of the tilt of the cap 23. Meanwhile, the protrusion 9*f* and the end 23*h* not in contact have an advantage of reduction in interference between the end 23*h* and the protrusion 9*f* when the cap 23 is mounted to the mouth 9.

The storage portion 7 includes a valve member mounting recess 7*a* composed of an inclined plane, and the recess 7*a* includes a fresh air inlet 15. The fresh air inlet 15 is a through hole provided only in the outer shell 19 and communicates an intermediate space 21 between the outer shell 19 and the inner bag 14 with an external space S of the container body 2. In the present embodiment, the fresh air inlet 15 has the valve member 5 mounted thereto to regulate entrance and exit of air between the intermediate space 21 and the external space S. The recess 7*a* is provided to avoid interference between the valve member 5 and a shrink film when the storage portion 7 is covered with the shrink film. In addition, not to tightly close the recess 7*a* with the shrink film, an air circulation groove 7*b* is provided that extends in the direction from the recess 7*a* to the mouth 9.

Figure 4A:
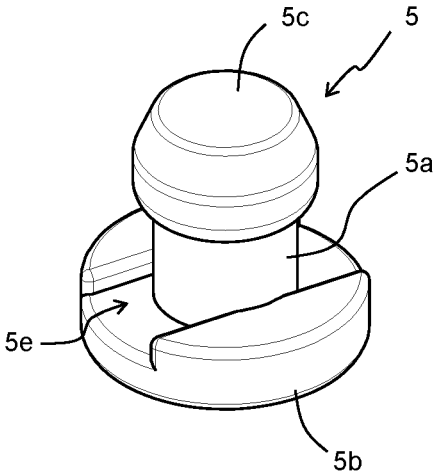
FIG. 4A is a perspective view of a valve member 5 and FIGS. 4B and 4C are cross-sectional views illustrating operations of the valve member 5.
Figure 4B:
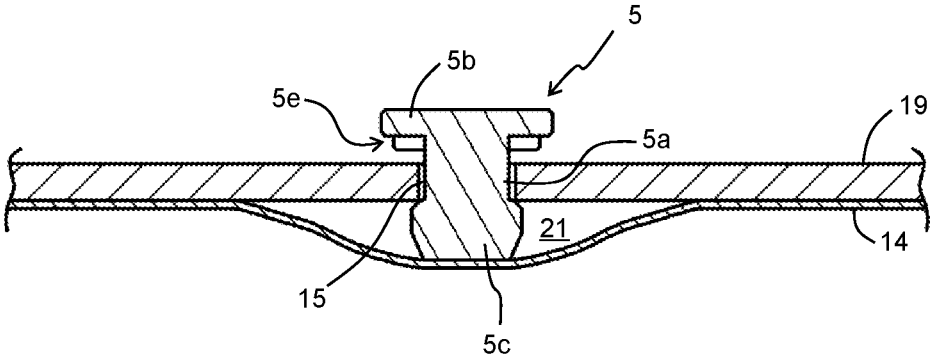
Figure 4C:
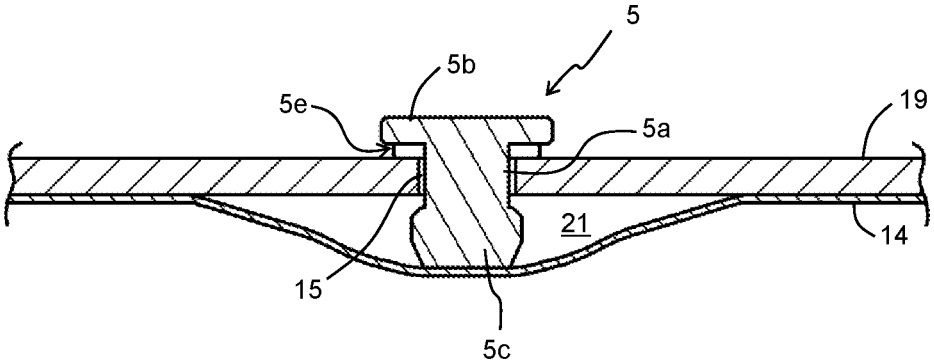

As illustrated in FIGS. 4A to 4C, the valve member 5 includes a stem 5*a* arranged in the fresh air inlet 15, a lid 5*c* provided on the intermediate space 21 side of the stem 5*a* and having a greater cross-sectional area than that of the stem 5*a*, and a locking portion 5*b* provided on the external space S side of the stem 5*a* and preventing entrance of the valve member 5 into the intermediate space 21. The lid 5*c* is inserted into the intermediate space 21 while pressing and expanding the fresh air inlet 15, thereby mounting the valve member 5 to the container body 2. Accordingly, the lid 5*c* preferably has an end in a tapered shape. Such a valve member 5 is mountable only by pressing the lid 5*c* into the intermediate space 21 from outside the container body 2 and is thus excellent in productivity.

The lid 5*c* is configured to substantially close the fresh air inlet 15 when the outer shell 19 is compressed and has a shape of a smaller cross-sectional area as getting closer to the stem 5*a*. The locking portion 5*b* is configured to allow introduction of air into the intermediate space 21 when the outer shell 19 restores its shape after compression. When the outer shell 19 is compressed, the pressure in the intermediate space 21 becomes higher than the external pressure, leading to leakage of air in the intermediate space 21 from the fresh air inlet 15 to the outside. This pressure difference and the air flow cause movement of the lid 5*c* toward the fresh air inlet 15 to, as illustrated in FIG. 4B, close the fresh air inlet 15 with the lid 5*c*. Since the lid 5*c* has the shape with a smaller cross-sectional area as getting closer to the stem 5*a*, the lid 5*c* readily fits in the fresh air inlet 15 to close the fresh air inlet 15.

When the outer shell 19 is compressed even more in this situation, the pressure in the intermediate space 21 increases, and as a result, the inner bag 14 is compressed to discharge the contents of the inner bag 14. When the compressive force to the outer shell 19 is released, the outer shell 19 attempts to restore its shape by the elasticity of its own. At this point, as illustrated in FIG. 4C, the lid 5*c* is separated from the fresh air inlet 15 and the closure of the fresh air inlet 15 is released to introduce fresh air into the intermediate space 21. Not to close the fresh air inlet 15 with the locking portion 5*b*, the locking portion 5*b* includes a flow passage 5*e* to allow introduction of fresh air into the intermediate space 21 through the flow passage 5*e* and the fresh air inlet 15 even when the locking portion 5*b* abuts on the outer shell 19.

The present embodiment is configured that the gap between an edge of the fresh air inlet 15 and the valve member 5 is opened and closed by the movement of the valve member 5 to allow the valve member 5 to open and close the fresh air inlet 15. Meanwhile, the valve member itself may be configured to have a through hole and an on-off valve, which acts to open and close the through hole, thereby opening and closing the fresh air inlet 15.

Then, the layer structure of the container body 2 is described in further detail. The container body 2 includes the outer layer 17 and the inner layer 13.

The outer layer 17 is formed of, for example, low-density polyethylene, linear low-density polyethylene, high-density polyethylene, polypropylene, an ethylene-propylene copolymer, or a mixture thereof, or the like. The outer layer 17 may have a multilayer structure. The structure may be, for example, a configuration in which both sides of a repro layer are sandwiched by layers formed of a virgin material. As used herein, the term "repro layer" refers to a layer formed by recycling burrs generated during container molding. The outer layer 17 is formed thicker than the inner layer 13 so as to increase the restorability thereof.

Figure 5:
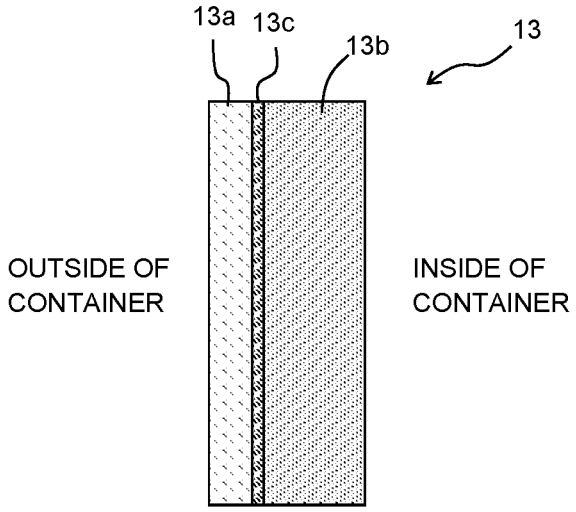
FIG. 5 is a cross-sectional view illustrating a layer structure of an inner layer 13.

As illustrated in FIG. 5, the inner layer 13 includes an EVOH layer 13*a* provided on a container outer surface side, an inner surface layer 13*b* provided on a container inner surface side of the EVOH layer 13*a*, and an adhesion layer 13*c* provided between the EVOH layer 13*a* and the inner surface layer 13*b*. By providing the EVOH layer 13*a*, it is possible to improve gas barrier properties and delamination properties from the outer layer 17. The adhesion layer 13*c* may be omitted.

The EVOH layer 13*a* is a layer containing an ethylene-vinyl alcohol copolymer (EVOH) resin and is obtained by hydrolysis of a copolymer of ethylene and vinyl acetate. The EVOH resin has an ethylene content, for example, from 25 to 50 mol %, and from the perspective of oxygen barrier properties, it is preferably 32 mol % or less. Although not particularly defined, the lower limit of the ethylene content is preferably 25 mol % or more because the flexibility of the EVOH layer 13*a* is prone to decrease when the ethylene content is less.

The inner surface layer 13*b* is a layer in contact with the contents of the delaminatable container 1. It contains, for example, polyolefin, such as low-density polyethylene, linear low-density polyethylene, high-density polyethylene, polypropylene, an ethylene-propylene copolymer, and a mixture thereof, and preferably low-density polyethylene or linear low-density polyethylene.

The adhesion layer 13*c* is a layer having a function of adhering the outside layer 13*a* to the inner surface layer 13*b*, and it is, for example, a product of adding acid modified polyolefin (e.g., maleic anhydride modified polyethylene) with carboxyl groups introduced therein to polyolefin described above or an ethylene-vinyl acetate copolymer (EVA). An example of the adhesion layer 13*c* is a mixture of acid modified polyethylene with low-density polyethylene or linear low-density polyethylene.

2. Second Embodiment

Figure 7A:
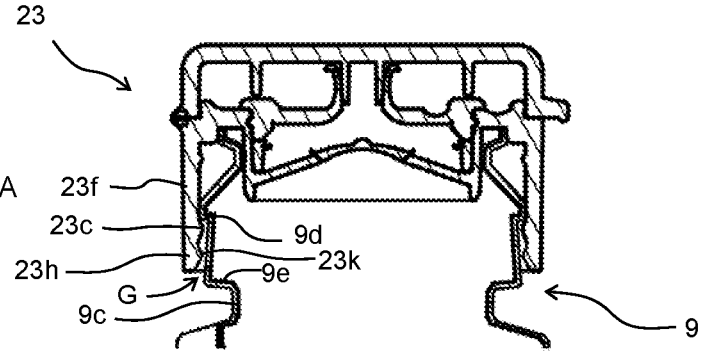
FIGS. 7A and 7B are cross-sectional views illustrating a mouth 9 and a cap 23 in the second embodiment of the present invention corresponding to FIGS. 2A and 2B.
Figure 7B:
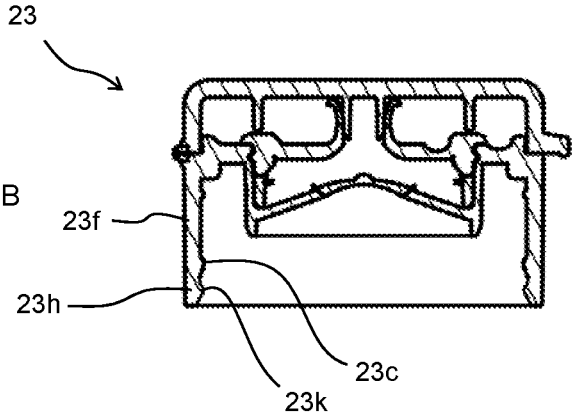

With reference to FIGS. 7A and 7B, the second embodiment of the present invention is described. The present embodiment is similar to the first embodiment and mainly differs in that a tilt suppressor is provided in a cap 23.

In the present embodiment, same as Comparative Example in FIG. 6, the mouth 9 has no protrusion 9*f*. In contrast, the configuration of the cap 23 is different from Comparative Example in FIG. 6 in that an end 23*h* includes a protrusion 23*k*. A gap G between the cap 23 and the mouth 9 at the end 23*h* is thus narrowed to suppress the tilt of the cap 23 relative to the mouth 9. Accordingly, in the present embodiment, the protrusion 23*k* functions as "the tilt suppressor" in the appended claims.

The present invention is allowed to be carried out in the following embodiments.

The protrusion 23*k* may be configured to be in contact with the mouth 9 although, in the second embodiment, the protrusion 23*k* is not in contact with the mouth 9 while the cap 23 is mounted to the mouth 9.

The mouth 9 may be provided with the protrusion 9*f* and the cap 23 may be provided with the protrusion 23*k* although, in the second embodiment, the mouth 9 has no protrusion 9*f*.

The valve member 5 may be omitted. In this case, the contents are allowed to be discharged by compression deformation of the outer shell 19 while the fresh air inlet 15 is closed with a finger or the like.

The fresh air inlet 15 may be provided in the mouth 9.

3. Third Embodiment

With reference to FIGS. 8A and 8B, the third embodiment of the present invention is described. The present embodiment is similar to the first embodiment and mainly differs in that a recess 16 is provided in the inner bag 14.

Here, with reference to FIGS. 8A to 8B and 4B to 4C, the technical meaning of providing the recess 16 in the inner bag 14 is described.

First, problems of the delaminatable container in FIGS. 4B to 4C are described. As illustrated in FIGS. 4B to 4C, at the first discharge of the contents, the inner bag 14 is inflated by the contents to be in a state where the inner bag 14 is in contact with the lid 5*c* of the valve member 5. When the compressive force is then released after the contents in the inner bag 14 are discharged by compressing the outer shell 19 and the inner bag 14, the outer shell 19 attempts to go away from the lid 5*c* to restore its original shape by the elasticity of its own. Since the inner bag 14 also attempts to restore its original shape by the elasticity of its own, a force in a direction of pressing the lid 5*c* against the outer shell 19 is applied to the lid 5*c* by the inner bag 14. When the inner bag 14 has sufficiently low rigidity, a gap is readily formed between the outer shell 19 and the lid 5*c* and the outer shell 19 immediately restores its original shape. In contrast, when the inner bag 14 has increased rigidity, the force increases and the lid 5*c* is firmly pressed against the outer shell 19. In this state, a gap is not readily formed between the outer shell 19 and the lid 5*c* and the outer shell 19 has worse restorability.

To solve such problems in the present embodiment, as illustrated in FIGS. 8A and 8B, the recess 16 recessing towards inside the container body 2 is provided in the inner bag 14 in the area facing the fresh air inlet 15 to have the surface area of the inner bag 14 in the area facing the fresh air inlet 15 greater than the open area of the fresh air inlet 15. Between the valve member 5 and the recess 16, a gap 16*s* is formed and the contact area between the valve member 5 and the inner bag 14 is reduced. Such configuration reduces the tension developed in the inner bag 14 when the inner bag 14 is pressed by the valve member 5 in the area where the valve member 5 is in contact with the inner bag 14. The force F in the direction of pressing the valve member 5 against the outer shell 19 by the inner bag 14 is thus less than that in the embodiment illustrated in 4B and 4C. A gap is readily formed between the outer shell 19 and the lid 5*c* after the first discharge of the contents, and fresh air is immediately introduced into the intermediate space 21 through the fresh air inlet 15 to immediately restore the original shape of the outer shell 19. Although the recess 16 in the present embodiment has a structure including a tube section 16*a* that has an approximately constant cross-sectional area towards inside the container body 2, the shape of the recess 16 is not particularly limited as long as the shape is capable of reducing the force F.

Then, an example of a method of producing the delaminatable container 1 in the present embodiment is described.

Figure 10A:
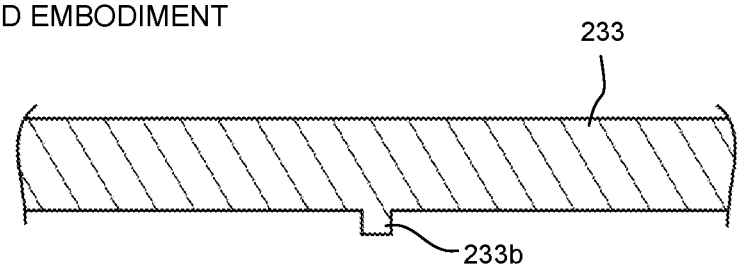
Figure 10B:
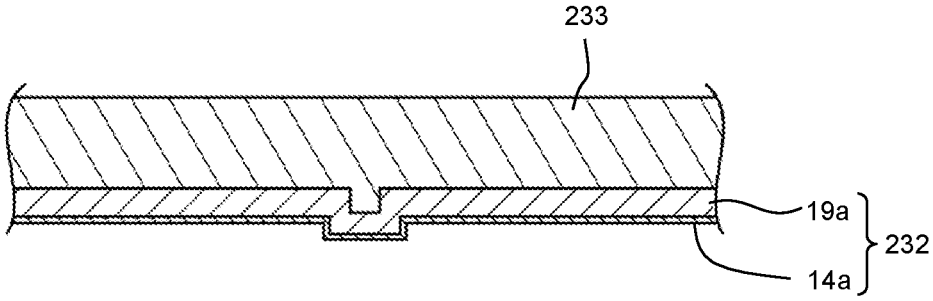

First, as illustrated in FIG. 9A, a cylindrical laminated parison 232 in a molten state having a laminated structure corresponding to the container body 2 to be produced is extruded from an extruder 231, and while the laminated parison 232 is set between blow molding split dies 233 and 234, the split dies 233 and 234 are closed. The split dies 233 and 234 are provided with cavities 233*a* and 234*a* in a shape corresponding to the container body 2. In the cavities 233*a* and 234*a* of the split dies 233 and 234, as illustrated in FIG. 10A, a projection 233*b* is provided in a position intended to form the fresh air inlet 15. As illustrated in FIG. 10B, the laminated parison 232 includes a layer 19*a* to be the outer shell 19 and a layer 14*a* to be the inner bag 14.

Then, as illustrated in FIG. 9B, a blow nozzle 236 is inserted into an opening on the mouth 9 side of the container body 2 to blow air into the cavities 233*a* and 234*a* of the split dies 233 and 234 in the mold closing state for blow molding. At this point, the laminated parison 232 is pressed against inner surfaces of the cavities 233*a* and 234*a*. Accordingly, as illustrated in FIG. 10B, the layers 19*a* and 14*a* constituting the laminated parison 232 has a recess formed in a shape along the projection 233*b*.

Figure 10C:
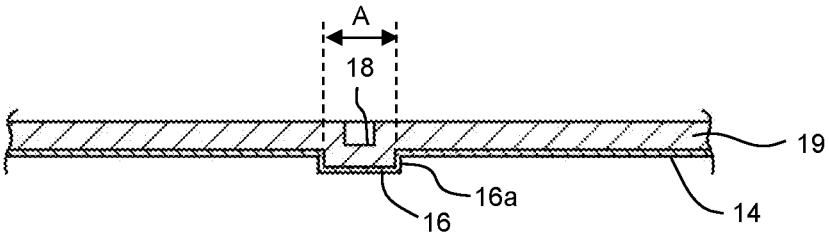

Then, as illustrated in FIG. 9C, the split dies 233 and are opened to take out a blow molded container body 2. As illustrated in FIG. 10C, the outer shell 19 and the inner bag 14 of the container body 2 have recesses 18 and 16 formed in the shape along the projection 233*b*.

Figure 10D:
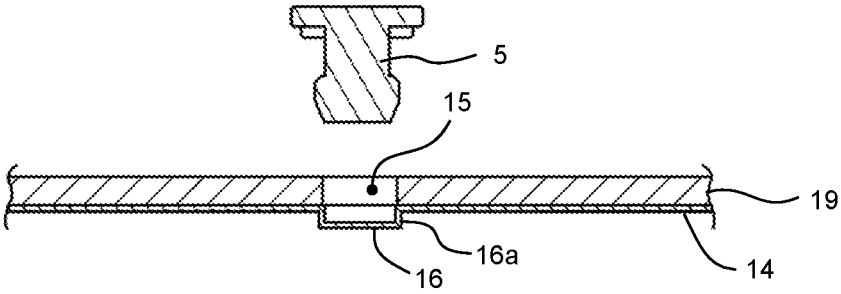

Then, as illustrated in FIGS. 10C and 10D, the outer shell 19 in a region A containing the recess 18 is removed to form the fresh air inlet 15 in the outer shell 19. At this point, the recess 16 of the inner bag 14 is left as is. Since the projection 233*b* is in a columnar shape in the present embodiment, the tube section 16*a* having an approximately constant cross-sectional area towards inside the container body 2 is formed in the recess 16.

Figure 10E:
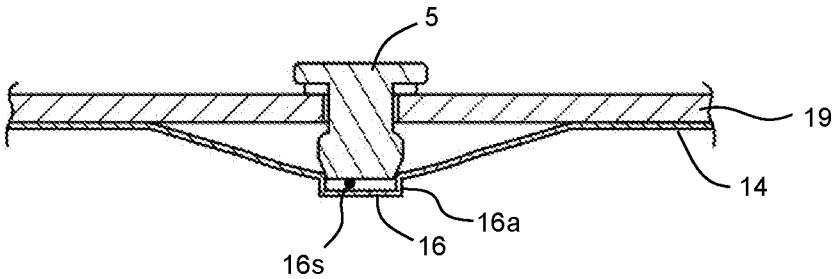

By the above procedure, the container body 2 having the recess 16 in the inner bag 14 formed in the area facing the fresh air inlet 15. Then, as illustrated in FIGS. 10D and 10E, the valve member 5 is mounted to the fresh air inlet 15 by inserting the valve member 5 into the fresh air inlet 15. Then, the cap 23 is mounted to the mouth 9 to produce the delaminatable container 1 illustrated in FIG. 1A.

4. Fourth Embodiment

With reference to FIGS. 11A to 11E, the fourth embodiment of the present invention is described. The present embodiment is similar to the third embodiment and mainly differs in that the recess 16 includes a curved surface 16*b*. The following description is mainly given to the differences.

Figure 11A:
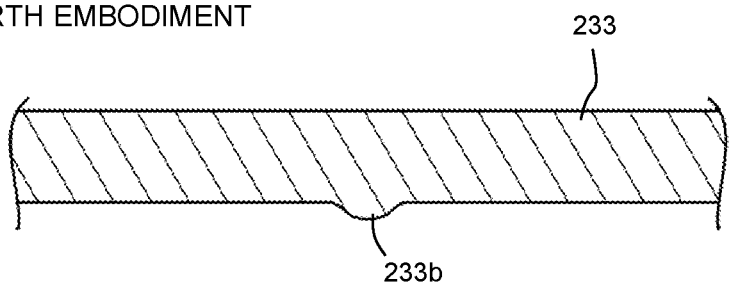
Figure 11B:
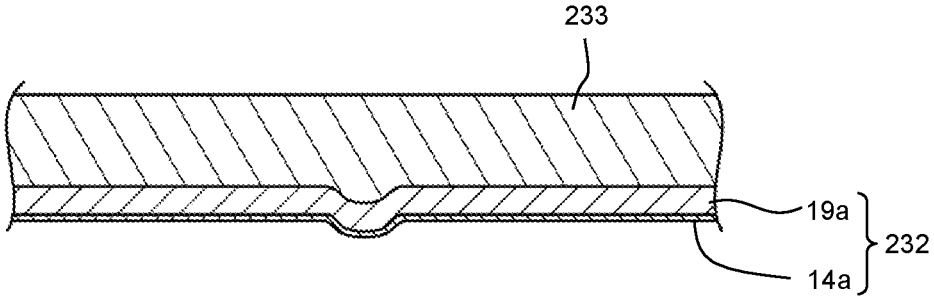
Figure 11C:
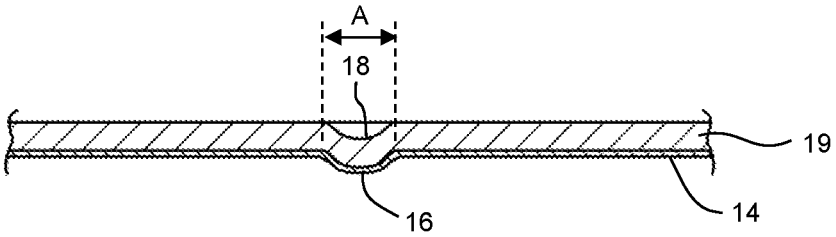

FIGS. 11A to 11E respectively correspond to FIGS. 10A to 10E. In the present embodiment, as illustrated in FIG. 11A, the projection 233*b* has a curved surface. As illustrated in FIG. 11B, the layers 19*a* and 14*a* thus have a recess formed in a curved shape along the projection 233*b*, and as illustrated in FIG. 11C, the outer shell 19 and the inner bag 14 of the container body 2 have the recesses 18 and 16 formed in a curved shape.

Figure 11D:
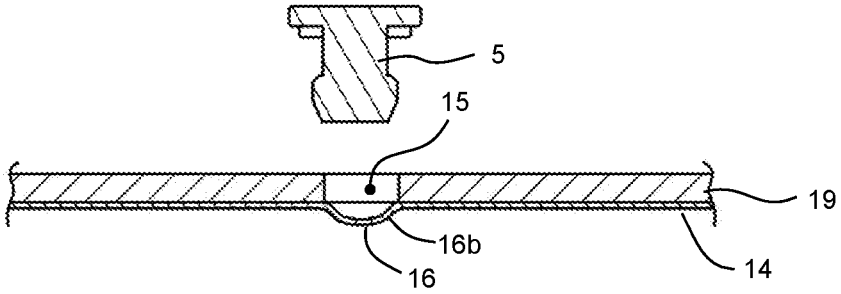

Then, as illustrated in FIGS. 11C and 11D, the outer shell 19 in the region A containing the recess 18 is removed to form the fresh air inlet 15 in the outer shell 19 and the recess 16 having a curved surface 16*b* is left.

Figure 11E:
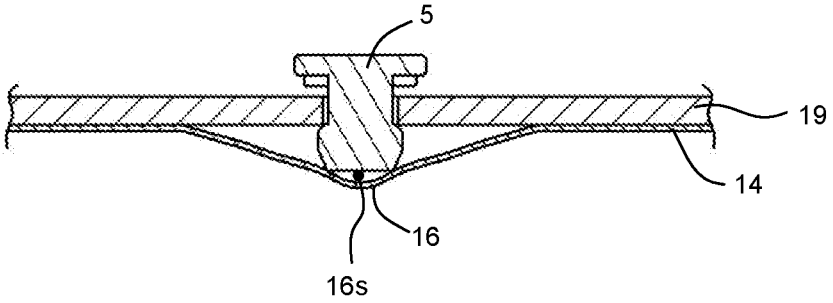

Then, as illustrated in FIGS. 11D and 11E, the valve member 5 is mounted to the fresh air inlet 15 by inserting the valve member 5 into the fresh air inlet 15. Between the valve member 5 and the recess 16, the gap 16*s* is formed and the contact area between the valve member 5 and the inner bag 14 is reduced.

In the configuration of the present embodiment as well, by providing the recess 16, the force F in the direction of pressing the valve member 5 against the outer shell 19 by the inner bag 14 is less than that in the embodiment illustrated in 4B and 4C. A gap is readily formed between the outer shell 19 and the lid 5*c* after the first discharge of the contents, and fresh air is immediately introduced into the intermediate space 21 through the fresh air inlet 15 to immediately restore the original shape of the outer shell 19.

5. Fifth Embodiment

With reference to FIGS. 12A to 12E, the fifth embodiment of the present invention is described. The present embodiment is similar to the fourth embodiment and mainly differs in that the split die 233 has a recess 233*c* in a curved shape. The following description is mainly given to the differences.

Figure 12A:
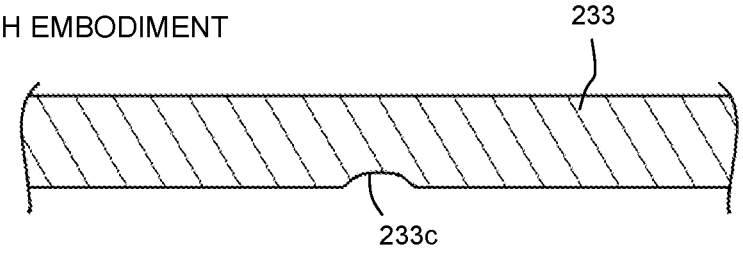
Figure 12B:
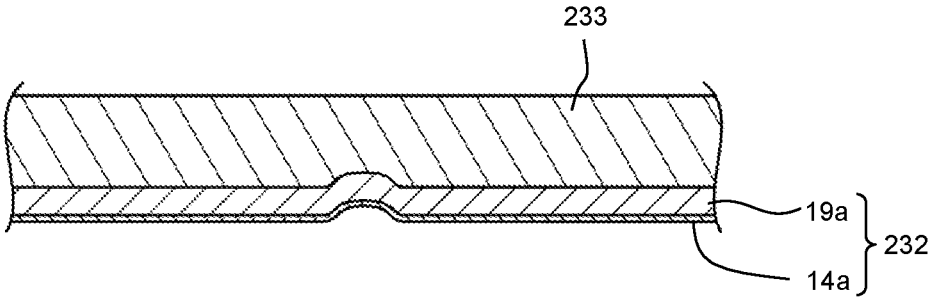
Figure 12C:
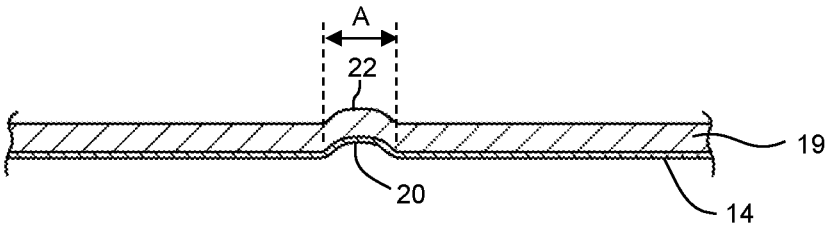

FIGS. 12A to 12E respectively correspond to FIGS. 11A to 11E. In the present embodiment, as illustrated in FIG. 12A, the split die 233 has the recess 233*c* in a curved shape. As illustrated in FIG. 12B, the layers 19*a* and 14*a* thus have a convexity formed in a curved shape along the recess 233*c*, and as illustrated in FIG. 12C, the outer shell 19 and the inner bag 14 of the container body 2 have convexities 22 and 20 formed in a curved shape.

Figure 12D:
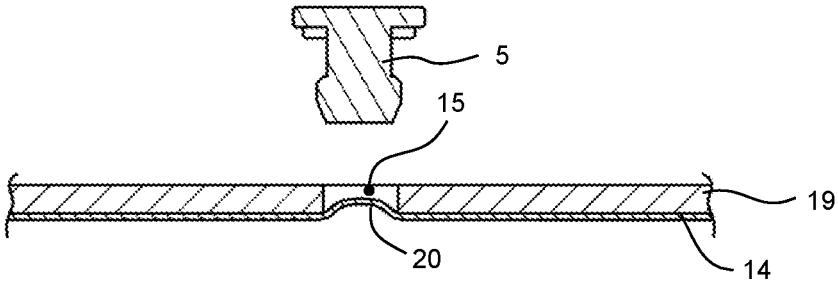

Then, as illustrated in FIGS. 12C and 12D, the outer shell 19 in a region A containing the convexity 22 is removed to form the fresh air inlet 15 in the outer shell 19 and the convexity 20 having a curved surface is left.

Figure 12E:
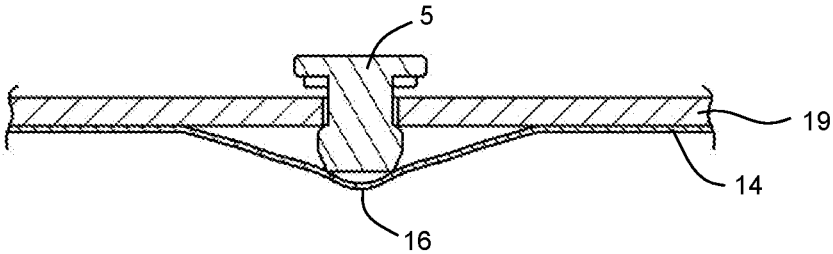

Then, as illustrated in FIGS. 12D and 12E, the valve member 5 is mounted to the fresh air inlet 15 by inserting the valve member 5 into the fresh air inlet 15. At this point, the convexity 20 is pressed by the valve member 5 to become the recess 16 and the shape illustrated in FIG. 12E is obtained.

In the configuration of the present embodiment, similar to the fourth embodiment, the force F in the direction of pressing the valve member 5 against the outer shell 19 by the inner bag 14 is reduced.

6. Sixth Embodiment

With reference to FIGS. 13A to 13E, the sixth embodiment of the present invention is described. The present embodiment is similar to the fourth embodiment and mainly differs in that the region A above is a region containing the entire recess 18, whereas the region A in the present embodiment is a region containing a portion of the recess 18. The following description is mainly given to the differences.

Figure 13A:
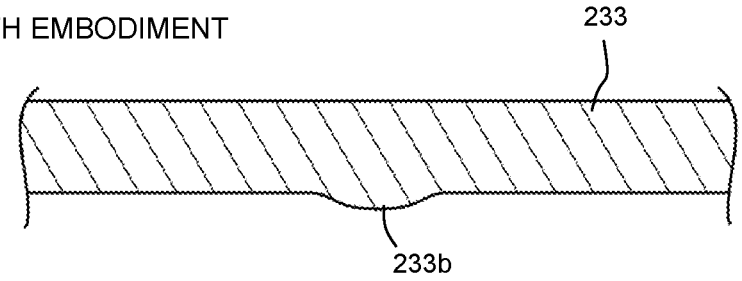
Figure 13B:
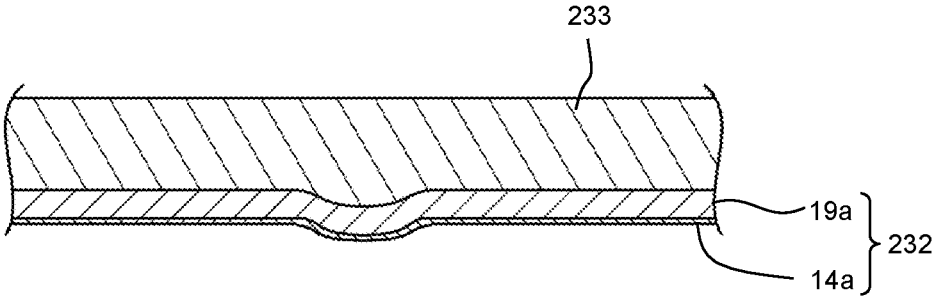
Figure 13C:
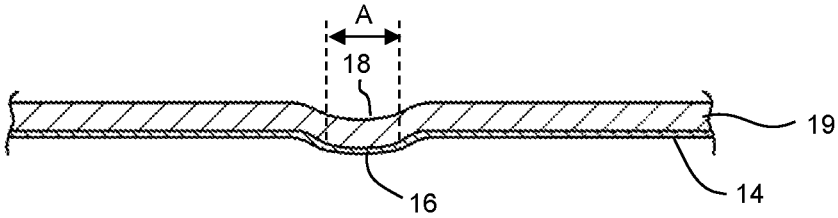

FIGS. 13A to 13E respectively correspond to FIGS. 11A to 11E. In the present embodiment, as illustrated in FIG. 13A, the projection 233*b* is formed over a region wider than that of the fourth embodiment. As illustrated in FIG. 13B, the layers 19*a* and 14*a* thus have a recess is formed over a wide region along the projection 233*b*, and as illustrated in FIG. 13C, the outer shell 19 and the inner bag 14 of the container body 2 have the recesses 18 and 16 formed over a wide region.

Figure 13D:
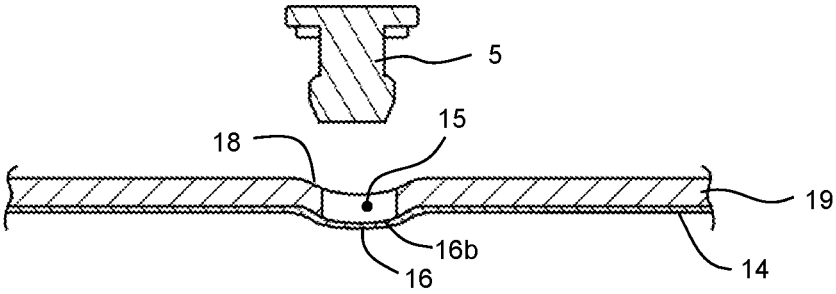

Then, as illustrated in FIGS. 13C and 13D, the outer shell 19 in a region A containing a portion of the recess 18 is removed to form the fresh air inlet 15 in the outer shell 19 and a portion of the recess 16 is exposed to the fresh air inlet 15 side.

Figure 13E:
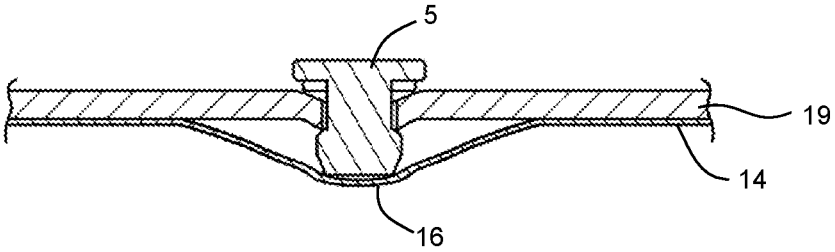

Then, as illustrated in FIGS. 13D and 13E, the valve member 5 is mounted to the fresh air inlet 15 by inserting the valve member 5 into the fresh air inlet 15. Between the valve member 5 and the recess 16, a gap is formed and the contact area between the valve member 5 and the inner bag 14 is reduced.

In the configuration of the present embodiment as well, by providing the recess 16, the force F in the direction of pressing the valve member 5 against the outer shell 19 by the inner bag 14 is less than that in the embodiment illustrated in 4B and 4C. A gap is readily formed between the outer shell 19 and the lid 5*c* after the first discharge of the contents, and fresh air is immediately introduced into the intermediate space 21 through the fresh air inlet 15 to immediately restore the original shape of the outer shell 19.

7. Seventh Embodiment

With reference to FIGS. 14 to 17, the delaminatable container 1 in the seventh embodiment of the present invention is described.

As illustrated in FIG. 14, the container body 2 is the main subject of the delaminatable container 1 in the present embodiment, and the container body 2 includes a storage portion 3 to store the contents and a mouth 4 to discharge the contents from the storage portion 3. The recess 7*a*, the air circulation groove 7*b*, and the valve member 5 are as described in the first embodiment.

In the container body 2, the mouth 4 is provided with an external screw portion, and to the external screw portion, a cap 30 having an internal screw is mounted. A detailed description is given below to the configuration of a mounting portion of the cap 30.

The cap 30 is mounted to the mouth 4 of the container body 2, and as illustrated in FIG. 15, composed of inner cap 31 directly fixed to the mouth 4 of the container body 2, screwed to an external screw portion 31*a* provided in the outer circumferential surface of the inner cap 31, a check valve 33, a nozzle portion 34 having a pouring outlet, and a lid (illustration omitted) covering the pouring outlet via a hinge or the like.

The inner cap 31 is mounted to the mouth 4 of the container body 2 by screwing or press fitting and has a top plate 31*b* covering the mouth 4, and the top plate 31*b* is provided with a circular hole 31*c* at the center. The circular hole 31*c* has an inner circumferential surface as an inclined plane with an upwardly enlarged diameter corresponding to a conical shape of a circumferential surface of a projection provided in the inner plug of the cap body 32.

Between the top plate 31*b* of the inner cap and an end surface of the mouth 4 of the container body 2, a sealing member 40 is interposed to seal the mouth 4 of the container body 2 by the sealing member 40. The sealing member 40 is fixed to the mouth 4 by, for example, being pasted over a lower surface of the top plate 31*b* of the inner cap 31 in advance and applying ultrasonic waves while the inner cap 31 is mounted to the mouth 4 of the container body 2. Naturally, not limited to this, the sealing member 40 may be fixed to the mouth 4 by a method, such as radio frequency sealing, for example.

The sealing member 40 seals the mouth 4 to tightly close the delaminatable container 1 filled with the contents for good storage life, and has to be formed with a material having barrier properties to fresh air, such as gas barrier properties and water vapor barrier properties. Accordingly, the sealing member 40 is preferably formed with aluminum and the like.

In the present embodiment, the sealing member 40 has a three-layer structure of a polypropylene layer, an aluminum layer, and a polypropylene layer laminated in this order. The sealing member 40 having a three-layer structure allows the sealing member 40 to seal the mouth 4 of the container body 2 by ultrasonic welding and the like.

The cap body 32 has an internal screw portion 32*a* in the inner circumferential surface for fixation by screwing in the external screw portion 31*a* formed in the outer circumferential surface of the inner cap 31. The cap body 32 has an inner plug 41 formed to block a flow passage in a position above the inner cap 31, and a protrusion 42 is formed at the center.

The protrusion 42 is formed protruding towards the sealing member (downwardly), and has an end in a peak shape (conical shape) and also has a content flow passage 42*a* formed from a midway position thereof penetrating to an outflow side of the inner plug. FIG. 16 is a plan view of the protrusion 42 taken from below (i.e., bottom view), and in this example, openings 42*c* of the content flow passage 42*a* are formed in the form of opening in two areas of the circumferential surface of the conical shape between a tip end 42*b* and a base end.

The content flow passage 42*a* formed in the protrusion 42 penetrates the outflow side of the inner plug 41, and a valve 33*a* of the check valve 33 abuts on an opening 42*d* on the outflow side for opening and closing operation.

Further, to the content outflow side of the cap body 32, a nozzle portion 34 having a pouring outlet 34*a* covering the check valve 33 is mounted to take out the contents from the pouring outlet 34*a*. A hinge cap is mounted covering the pouring outlet 34*a* of the nozzle portion 34 while illustration is omitted here.

In the cap mounting portion having the above configuration, as illustrated in FIG. 15, the mouth 4 of the container body 2 is sealed by the sealing member 40 during storage and the tightly closed condition is kept, thereby inhibiting content degradation and the like to a minimum.

In contrast, for unsealing, the cap body 32 is screwed to move the protrusion 42 formed at the center of the inner plug 41 forward to the sealing member 40 and break through the sealing member 40 with the tip end and thus unsealing is carried out. Accordingly, the cap body 32 is screwed in the inner cap 31 to a position not to hit the sealing member 40 with the tip end of the protrusion 42 during storage to allow unsealing operation by further screwing at the time of unsealing. For this purpose, for example, a stopper or the like is preferably provided in the external screw portion 31*a* of the inner cap 31 to keep the screwing of the cap body 32 in a position not to hit the sealing member 40 with the tip end of the protrusion 42 during storage. With such preparation, the cap body 32 is not screwed during storage and unintended unsealing is avoided. For use, the stopper may be removed to screw the cap body 32.

FIG. 17 is a drawing illustrating an unsealed state of the sealing member 40. For unsealing, the sealing member 40 is broken with the tip end of the protrusion 42 provided in the inner plug 41 to be unsealed. At this point, the tip end of the protrusion 42 has a peak shape (conical shape) and the openings 42*c* of the content flow passage 42*a* are located in the midway of the outer circumferential surface of the protrusion 42, and thus the cut fragments of the sealing member 40 do not close the openings 42*c* unintentionally to certainly secure the flow passage.

In the state of unsealing the sealing member 40 with the protrusion 42, the outer circumferential surface of the conical shape of the protrusion 42 abuts on the inner circumferential surface of the hole 31*c* of the inner cap 31. When the diameter at the base end of the protrusion 42 is set greater than the maximum diameter of the hole 31*c* of the inner cap 31, the outer circumferential surface of the conical shape of the protrusion 42 is securely brought to abut on the opening circumference of the hole 31*c* of the inner cap 31 even with insufficient molding precision of the diameter of the protrusion 42 or the diameter of the hole 31*c* of the inner cap 31, and the tight closure in this area is thus maintained. Delaminatable containers are often required to avoid backflow of the air into the container as much as possible, and it is extremely important to secure the tight closure in the areas other than the unsealed area even after unsealing.

In the state of unsealing the sealing member 40, the mouth 4 of the container body 2 is communicable with the outside via the content flow passage 42*a* provided in the protrusion 42 and the pouring outlet 34*a* of the nozzle portion 34 to allow pouring of the contents. For example, when an outer shell 11 is compressed, the internal pressure of the container body 2 increases and the valve 33*a* of the check valve 33 in abutment on the openings 42*c* of the content flow passage 42*a* separates from the openings 42*c* to open the openings 42*c* of the content flow passage 42*a*. As a result, the contents passes through the content flow passage 42*a* of the protrusion 42 breaking through the sealing member 40 and is poured from the pouring outlet 34*a* of the nozzle portion 34 to outside. By releasing the compression of the outer shell 11, the internal pressure of the container body 2 decreases and the valve 33*a* of the check valve 33 abuts on the openings 42*c* of the content flow passage 42*a* to be in the tightly closed condition.

REFERENCE SIGNS LIST

1: Delaminatable Container, 2: Container Body, 3: Storage Portion, 4: Mouth, 5: Valve Member, 5*a*: Stem, 5*b*: Locking Portion, 5*c*: Lid, 5*e*: Flow Passage, 7: Storage Portion, 7*a*: Valve Member Mounting Recess, 7*b*: Air Circulation Groove, 9: Mouth, 9*a*: Abutment Section, 9*b*: Enlarged Diameter Portion, 9*d*: Engagement Section, 9*e*: Upper Wall, 9*f*: Protrusion, 9*g*: opening, 10: Support, 11: Outer Shell, 13: Inner Layer, 13*a*: EVOH Layer, 13*b*: Inner Surface Layer, 13*c*: Adhesion Layer, 14: Inner Bag, 15: Fresh Air Inlet, 16: recess, 16*a*: Tube Section, 16*b*: Curved Surface, 16*s*: Gap, 17: Outer Layer, 18: Recess, 19: Outer Shell, 20: Convexity, 21: Intermediate Space, 22: Convexity, 23: Cap, 23*a*: Cap Body, 23*b*: Outlet, 23*c*: Engagement Section, 23*d*: Inner Ring, 23*e*: Check Valve, 23*f*: Tube Section, 23*g*: Flow Passage, 23*h*: End, 23*i*: Cap Cover, 23*j*: Coupling Portion, 23*k*: Protrusion, 23*t*: Upper Portion, 30: Cap, 31: Inner Cap, 31*a*: External Screw Portion, 31*b*: Top Plate, 31*c*: Hole, 32: Cap Body, 32*a*: Internal Screw Portion, 33*a*: Valve, 34: Nozzle Portion, 34*a*: Pouring Outlet, 40: Sealing Member, 41: Inner Plug, 42: Protrusion, 42*a*: Content Flow Passage, 42*b*: Tip End, 42*c*: Opening, 42*d*: Opening, 231: Extruder, 232: Laminated Parison, 233: Split Die, 233*a*: Cavity, 233*b*: Projection, 233*c*: Recess, 234: Split Die, 234*a*: Cavity, 236: Blow Nozzle

The invention claimed is:

1. A delaminatable container comprising a container body having an outer shell and an inner bag, the inner bag to be shrunk with a decrease in contents, wherein the outer shell includes a fresh air inlet communicating with an external space of the container body, the inner bag has a surface area in an area facing the fresh air inlet greater than an open area of the fresh air inlet, a valve member is mounted to the fresh air inlet, the valve member is configured to open and close the fresh air inlet by opening and closing a gap between an edge of the fresh air inlet and the valve member by movement of the valve member, and the valve member is in contact with a cylindrical tube section of the inner bag in such a way that space is provided between a lid of the valve member and the cylindrical tube section of the inner bag.

2. The container of claim 1, wherein the inner bag includes a recess recessed towards inside the container body in an area facing the fresh air inlet.

3. The container of claim 1, wherein the container body includes a storage portion to store the contents and a mouth to discharge the contents from the storage portion, and the fresh air inlet is provided in the storage portion.

4. The container of claim 1, wherein the valve member includes a stem inserted into the fresh air inlet, a lid provided on a side of an intermediate space between the outer layer and the inner layer in the stem and having a cross-sectional area greater than that of the stem, and a locking portion provided on a side of the external space in the stem and preventing entrance of the valve member to the intermediate space.

5. A delaminatable container, comprising an outer shell and an inner bag, the inner bag to be shrunk with a decrease in contents, wherein a mouth is sealed by a sealing member and a cap having a check valve is mounted to the mouth, the cap has an inner plug with a protrusion formed protruding towards the sealing member, the protrusion has an end in a conical shape and is formed with a content flow passage penetrating to an outflow side of the inner plug at an opening disposed in a midway position of the protrusion, wherein the content flow passage extends coaxially with the protrusion, the opening, the opening is open in a direction perpendicular to the content flow passage, and, by screwing the cap in, the protrusion of the inner plug breaks through the sealing member for unsealing.

6. The container of claim 5, wherein the sealing member is fixed with its surroundings put between the mouth and an inner cap, the inner cap having a hole formed in a position facing the protrusion, and when the cap is screwed in, a circumferential surface of the protrusion in the peak shape abuts on a periphery of the hole of the inner cap.

7. The container of claim 5, wherein the check valve opens and closes an opening on the outflow side of the content flow passage formed in the protrusion.

8. The container of claim 5, wherein the sealing member is a multilayered film having a polypropylene layer, an aluminum layer, and a polypropylene layer laminated in this order.

* * * * *